US007546741B2

(12) United States Patent
Sasao et al.

(10) Patent No.: US 7,546,741 B2
(45) Date of Patent: Jun. 16, 2009

(54) IGNITION DETECTING SYSTEM AND METHOD FOR GAS TURBINE

(75) Inventors: Toshifumi Sasao, Mito (JP); Youtarou Kimura, Hitachinaka (JP); Isao Takehara, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 385 days.

(21) Appl. No.: 11/206,732

(22) Filed: Aug. 19, 2005

(65) Prior Publication Data

US 2006/0053802 A1 Mar. 16, 2006

(30) Foreign Application Priority Data

Sep. 15, 2004 (JP) ..... 2004-267684

(51) Int. Cl.
*F02C 7/26* (2006.01)

(52) U.S. Cl. ..... 60/778; 60/779; 60/786; 60/803

(58) Field of Classification Search ..... 60/39.091, 60/39.281, 39.821, 776, 778, 779, 786, 790, 60/803

See application file for complete search history.

(56) References Cited

U.S. PATENT DOCUMENTS 6,274,945 B1 * 8/2001 Gilbreth et al. ..... 290/52
6,766,647 B2 * 7/2004 Hartzheim ..... 60/778

FOREIGN PATENT DOCUMENTS

JP 59-15638 1/1984

* cited by examiner

*Primary Examiner*—Louis J Casaregola
(74) *Attorney, Agent, or Firm*—Mattingly & Malur, PC

(57) ABSTRACT

A gas turbine which can detect ignition in a combustor regardless of startup conditions of the gas turbine, such as the hot startup or the cold startup. An ignition detecting method for the gas turbine comprises the steps of calculating a difference between the exhaust temperature detected at a particular time before outputting of an ignition command for a combustor and the exhaust temperature detected after the outputting of the ignition command, and determining that the combustor is ignited, when the calculated difference is not less than a predetermined value. As an alternative, the method includes a step of determining that the combustor is ignited, when a change amount or rate of the exhaust temperature exceeds a predetermined value in a predetermined period from the outputting time of the ignition command.

9 Claims, 6 Drawing Sheets

IGNITION DETECTING SYSTEM AND METHOD FOR GAS TURBINE

BACKGROUND OF THE INVENTION

1. Field of the Invention

The present invention relates to an ignition detecting method for a multi-chamber gas turbine provided with a plurality of combustors.

2. Description of the Related Art

One example of known techniques for detecting an ignition failure at the startup of a gas turbine combustor without using a flame sensor is disclosed in, e.g., Patent Reference 1; JP-A-59-15638. According to JP-A-59-15638, if the exhaust temperature is still low even after the lapse of a certain time from the startup, this is determined as indicating the occurrence of an ignition failure, and fuel supply is stopped.

SUMMARY OF THE INVENTION

The startup mode of a gas turbine is mainly divided into hot startup and cold startup depending on a temperature condition at the startup of the gas turbine. Between the hot startup and the cold startup, there is a large difference in output of an exhaust temperature sensor, i.e., exhaust temperature, immediately prior to ignition. For example, the exhaust temperature in the cold startup is equal to about the atmospheric temperature, and the exhaust temperature in the hot startup is about 200-300° C. Because of such a large difference in exhaust temperature at the time of ignition between the hot startup and the cold startup, it is difficult or uncertain to reliably determine an ignition failure in both the hot startup and the cold startup with the above-mentioned known technique of determining an ignition failure based on an absolute value of the gas turbine exhaust temperature, as disclosed in JP-A-59-15638.

Accordingly, an object of the present invention is to provide an ignition detecting method for a gas turbine, which can detect ignition in a combustor regardless of startup conditions of the gas turbine, such as the hot startup or the cold startup.

When calculating, on the basis of an exhaust temperature at a certain particular time (e.g., an ignition command outputting time) before ignition, a difference between an exhaust temperature after ignition and the reference exhaust temperature, and looking at an increase of the difference, the difference is increased with the establishment of ignition regardless of the hot startup or the cold startup, and exceeds a predetermined value after the lapse of a predetermined time. With attention paid to the above point, the present invention is featured in determining that ignition has been established, when the increase of the exhaust temperature after the ignition exceeds a predetermined value.

Practically, an ignition detecting method for a gas turbine according to the present invention comprises the steps of calculating a difference between the exhaust temperature detected at a particular time before the outputting of an ignition command for a combustor and the exhaust temperature detected after the outputting of the ignition command, and determining that the combustor is ignited, when the calculated difference is not less than a predetermined value.

As an alternative, the ignition detecting method may comprise the steps of calculating a change amount (rate) of the exhaust temperature with respect time after the particular time, and determining that the combustor is ignited, when the calculated change rate is not less than a predetermined value. Further, the ignition detecting method may comprise the steps of calculating a change amount (rate) of the exhaust temperature with respect a revolution speed of the gas turbine after the particular time, and determining that the combustor is ignited, when the calculated change rate is not less than a predetermined value.

According to the present invention, it is possible to provide an ignition detecting method for a gas turbine, which can reliably determine ignition in a combustor regardless of startup conditions of the gas turbine, such as the hot startup or the cold startup.

DESCRIPTION OF THE PREFERRED EMBODIMENTS

Figure 1:
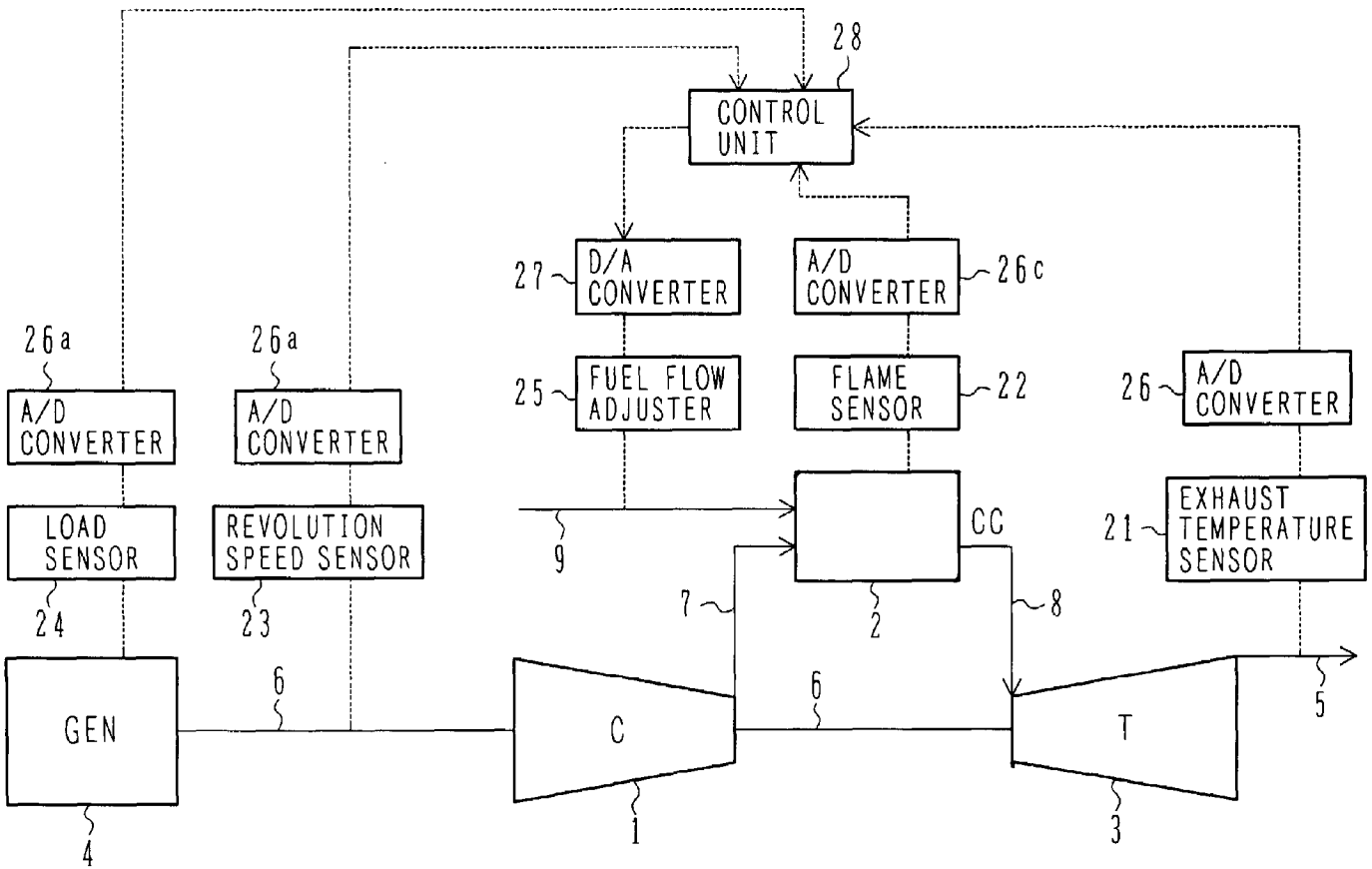
FIG. 1 is a block diagram of principal components of a gas turbine for use with an ignition detecting method according to each embodiment of the present invention.

FIG. 1 schematically shows the construction of a gas turbine for use with an ignition detecting method according each embodiment of the present invention. The illustrated gas turbine comprises a plurality (six in this embodiment, but only one is shown in FIG. 1) of combustors 2 for burning fuel supplied through a fuel pipe 9 and air supplied through a compressed air channel 7, a turbine 3 driven for rotation by combustion gases produced in the combustors 2 and supplied through respective combustion gas channels 8, a compressor 1 driven for rotation by the turbine 3 through a turbine shaft 6 and sending compressed air to the compressed air channel 7, a generator 4 driven for rotation by the turbine 3 through the turbine shaft 6 and generating electric power, an exhaust gas channel 5 through which the combustion gases after having been used to drive the turbine 3 is discharged, and a control unit 28 for controlling the flow rate of fuel supplied to the combustors 2.

Further, the gas turbine of the illustrated embodiment comprises an exhaust temperature sensor 21 for detecting the exhaust temperature in the exhaust gas channel 5, a revolution speed sensor 23 for detecting the revolution speed of the turbine shaft 6, a load sensor 24 for detecting the load of the generator 4, and a fuel flow adjuster 25 disposed in the fuel pipe 9 and adjusting the flow rate of fuel. Output signals from those various sensors 21, 23 and 24 are converted to digital signals by A/D converters 26*a*-26*c*, respectively, and the digital signals are transmitted to the control unit 28. In accordance with the detected signals from those various sensors, the control unit 28 outputs a control signal for the fuel flow adjuster 25. The output signal from the control unit 28 is converted to an analog signal by a D/A converter 27 and transmitted to the fuel flow adjuster 25.

The exhaust temperature sensor 21 for detecting the gas turbine exhaust temperature is a temperature detecting means prepared using an ordinary temperature sensor, such as a thermocouple. In practice, the exhaust temperature sensor 21 is disposed plural along a circumference in the exhaust gas channel to measure the temperatures of the gas turbine exhaust gases at a plurality of points. Each exhaust temperature sensor 21 outputs an analog signal depending on the exhaust temperature. The analog signal is converted to a digital signal of a predetermined voltage by the A/D converter 26*c*, and the digital signal is sent to the control unit 28.

The revolution speed sensor 23 detects the turbine revolution speed. For example, a part of the turbine shaft 6 on the inlet side of the compressor 1 is machined into the form of a gear, and analog signals are outputted depending on magnetic conditions at mountains and valleys of the gear by using a magnetic sensor or the like. Those analog signals are each converted to a digital signal of a predetermined voltage by the A/D converter 26*b*, and the digital signal is sent to the control unit 28.

In addition to the above-mentioned sensors 21, 23 and 24, the gas turbine may further optionally include, like the illustrated embodiment, a flame sensor 22 as a means for detecting a flame. In that case, the flame sensor 22 may be disposed for each of any suitable number (two in the illustrated embodiment) of the combustors instead of being disposed in one-to-one relation to all the combustors. An output signal of the flame sensor 22 is transmitted as an input signal to the control unit 28 through an A/D converter 26*d*. The flame sensor 22 is mounted plural to each monitoring window of the plurality of associated combustors and outputs a current depending on the intensity of light emitted from a combustion flame by using a photosensor, for example. Then, the A/D converter 26*d* outputs a digital value of 1 when the output current from the flame sensor 22 exceeds a certain value, and a digital value of 0 when the output current from the flame sensor 22 does not exceed the certain value. The thus-obtained digital signal is outputted to the control unit 28.

The control unit 28 receives the digital signals from the various sensors 21-24, monitors those signals, and executes arithmetic/logical operations based on them. Then, the control unit 28 outputs, as digital signals, the control signal to the fuel flow adjuster 25, an alarm command signal to an alarm device, etc.

The fuel flow adjuster 25 is mounted to the fuel pipe 9. The digital signal outputted from the control unit 28 is converted by the D/A converter 27 to an analog signal for adjusting the opening degree of a fuel valve. The fuel flow adjuster 25 adjusts the opening degree of the fuel valve in accordance with that analog signal, thereby adjusting the flow rate of fuel.

Figure 2:
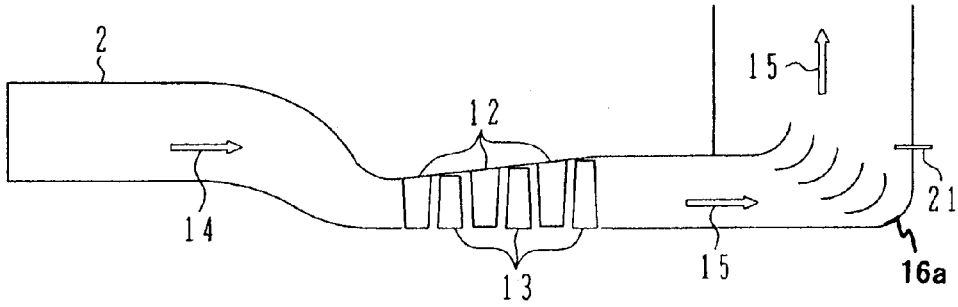
FIG. 2 is a schematic view of an exhaust duct in a gas turbine of lateral-flow exhaust type.

The shape of the exhaust duct will be described below with reference to FIGS. 2 and 3. FIG. 2 is a schematic view of an exhaust duct in a gas turbine of lateral-flow exhaust type, and FIG. 3 is a schematic view of an exhaust duct in a gas turbine of axial-flow exhaust type.

Figure 3:
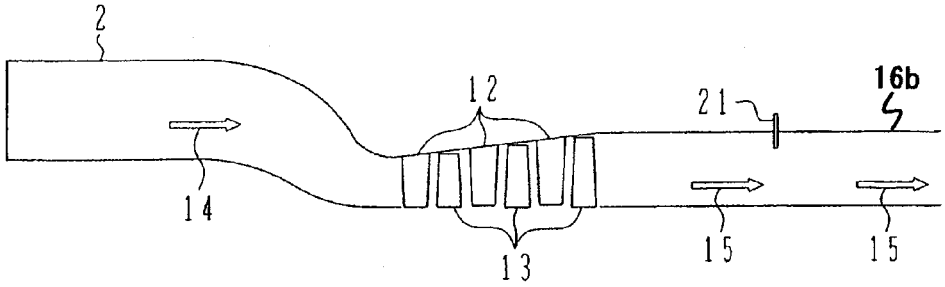
FIG. 3 is a schematic view of an exhaust duct in a gas turbine of axial-flow exhaust type.

The shape of the exhaust duct is classified into two types, as shown in FIGS. 2 and 3, depending on the type of gas turbine. An exhaust duct 16*a* shown in FIG. 2 is called the lateral-flow exhaust type in which combustion gases 14 introduced from the combustor 2, not shown in FIG. 2, pass nozzles 12 and blades 13 and become exhaust gases 15, which are bent in a direction perpendicularly to the turbine shaft in the downstream side of the exhaust gas channel. The exhaust temperature sensor 21 is disposed in the downstream side of the exhaust gas channel (downstream of a duct bent portion in the illustrated example) such that a sensor unit of the exhaust temperature sensor 21 is projected into the channel parallel to the direction of the turbine shaft.

Also, an exhaust duct 16*b* shown in FIG. 3 is called the axial-flow exhaust type in which the exhaust gases 15 discharged after passing the nozzles 12 and the blades 13 flow in the direction of the turbine shaft without being bent. In the case of the exhaust duct 16*b* shown in FIG. 3, the exhaust temperature sensor 21 is disposed in the downstream side of the exhaust gas channel such that a sensor unit of the exhaust temperature sensor 21 is projected into the channel in a direction perpendicular to the turbine shaft.

Figure 4:
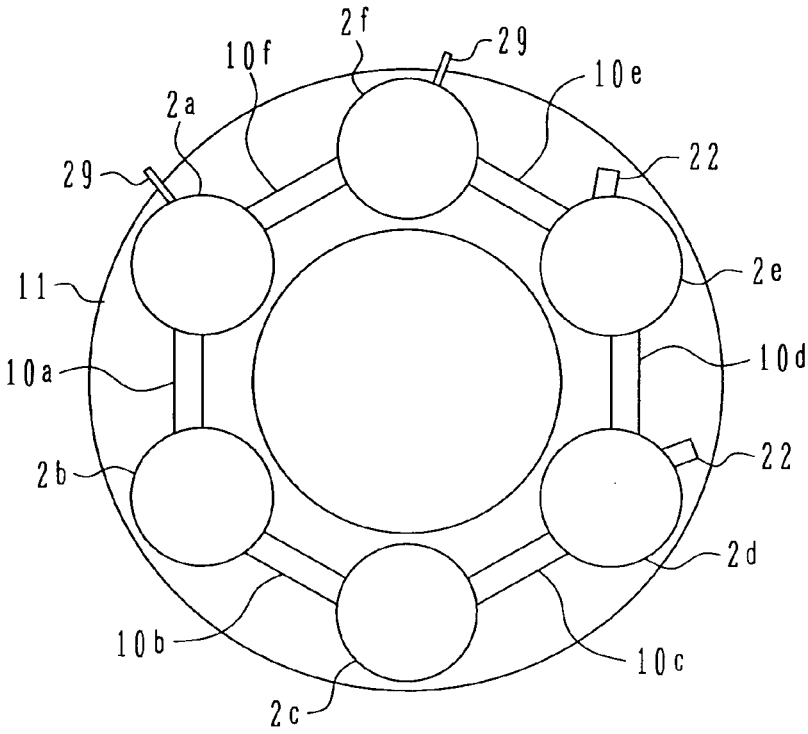
FIG. 4 is a sectional view of combustors in a multi-chamber gas turbine.

FIG. 4 is a sectional view of combustors in a multi-chamber gas turbine. Each combustor 2 mixes and burns fuel and compressed air delivered from the compressor 1, thereby producing high-temperature and high-pressure combustion gases. Energy of the produced high-temperature and high-pressure combustion gases is converted to energy of rotation by the turbine.

In the example shown in FIG. 4, combustors 2*a*-2*f* are mounted within a casing 11 having a circular cross-section so as to lie on a circumference in concentric relation to the casing 11, and each of the combustors 2*a*-2*f* is coupled to adjacent one through any of flame propagating pipes 10*a*-10*f*. At the startup of the gas turbine, some of the combustors (2*a* and 2*f* in the illustrated example) are ignited by ignition plugs 29 mounted to those combustors 2*a*, 2*f*. A flame produced with the ignition in the combustor 2*a* is propagated to the adjacent combustor 2*b* through the flame propagating pipe 10*a*. Likewise, a flame produced in the combustor 2*f* is propagated to the adjacent combustor 2*e* through the flame propagating pipe 10*e*. Subsequently, the flame is propagated from the combustor 2*b* to the combustor 2*c* through the flame propagating pipe 10*b*, while the flame is propagated from the combustor 2*e* to the combustor 2*d* through the flame propagating pipe 10*d*. In this way, the flame is successively propagated from one combustor to the next adjacent combustor in two opposite directions so that all the combustors are eventually ignited.

Further, in the example shown in FIG. 4, the flame sensors 22 are mounted to the combustors 2*d*, 2*e* other than the combustors 2*a*, 2*f* provided with the ignition plugs 29. When those two flame sensors 22 detect flames, it is determined that all the combustors have been ignited. With such a method of detecting a flame by the flame sensor 22, however, the flame sensor 22 must be mounted to the combustor 2. Also, since the combustor is subjected to an atmosphere at high temperatures under high pressures, the flame sensor 22 must be highly durable against such an atmosphere. Further, a cooling device (such as a water cooling jacket or an air cooling device) for cooling the flame sensor 22 is required in some cases.

In view of the above-described situation, the gas turbine of the illustrated embodiment is intended to detect the establishment of ignition in the combustor by the following method with no need of using any flame sensor 22.

Figure 5:
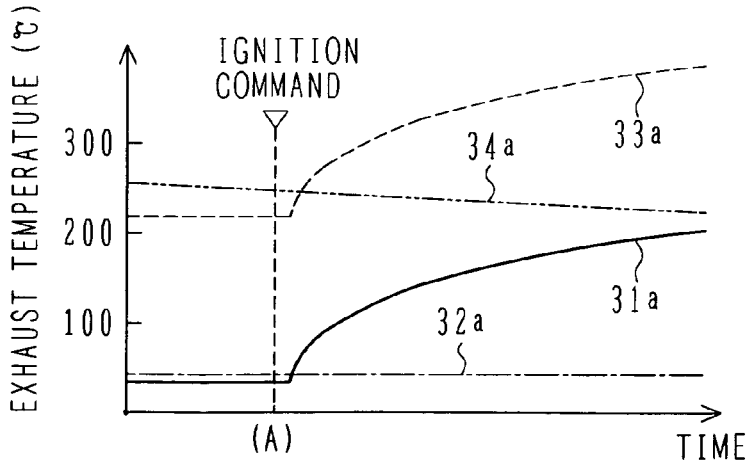
FIG. 5 is a graph showing one example of behavior of the gas turbine exhaust temperature at the time of ignition.

FIG. 5 shows one example of behavior of the gas turbine exhaust temperature at the time of ignition. Assuming that an ignition command is issued at a time indicated by (A) in FIG. 1, the exhaust temperature behaves as represented by a solid line 31*a* when ignition has succeeded in the case of the cold startup. When ignition has failed, the exhaust temperature behaves as represented by a one-dot chain line 32*a*. On the other hand, in the case of the hot startup, the exhaust duct is not sufficiently cooled and high-temperature gases reside within the exhaust duct. Thus, since the exhaust temperature measured at the start of ignition is high, the exhaust temperature behaves as represented by a broken line 33*a* when ignition has succeeded, and behaves as represented by a two-dot chain line 34*a* when ignition has failed. As seen from FIG. 5, an absolute value of the exhaust temperature at the start of ignition greatly differs depending on the startup conditions of the gas turbine, and therefore it is difficult to determine the establishment of ignition based on the absolute value of the exhaust temperature.

Figure 6:
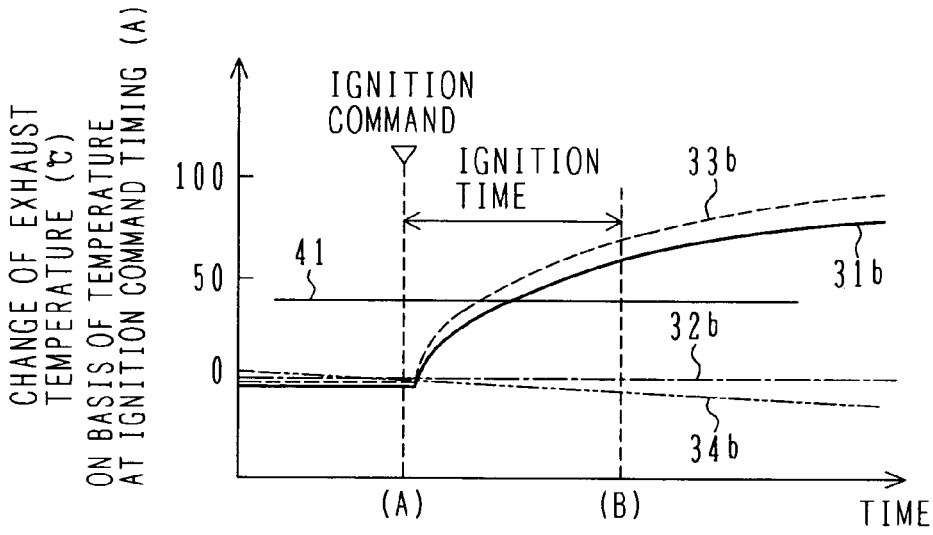
FIG. 6 is a graph showing one example of behavior of a change amount of the gas turbine exhaust temperature at the time of ignition.

In order to avoid such a difficulty, one embodiment of the ignition detecting method is constituted as follows. Assuming that the exhaust temperature at a particular time not later than the issuance of the ignition command (at an ignition command outputting time (A) in this embodiment) is TX(A) and the exhaust temperature at a particular time after the issuance of the ignition command is TX, an exhaust temperature change amount (TX−TX(A)) is calculated on the basis of TX(A). As a result of the calculation, the respective behaviors of the exhaust temperature, shown in FIG. 5, are converted to behaviors of change amounts of the exhaust temperature as shown in FIG. 6. In other words, a solid line 31*b* represents the behavior of change amount of the exhaust temperature when ignition has succeeded in the case of the cold startup, and a one-dot chain line 32*b* represents that behavior when ignition has failed. Also, a broken line 33*b* represents the behavior of change amount of the exhaust temperature when ignition has succeeded in the case of the hot startup, and a two-dot chain line 34*b* represents that behavior when ignition has failed.

Looking at a change of the exhaust temperature in terms of a change amount from a certain reference, as described above, the change amount of the exhaust temperature increases when ignition has succeeded, and it does not increase when ignition has failed, regardless of the startup conditions of the gas turbine, etc. In view of that point, the change amount of the exhaust temperature from the certain reference exhaust temperature TX(A) is computed and the establishment of ignition is determined when the change amount exceeds a predetermined value 41 within a certain ignition time as shown in FIG. 6. On the other hand, when the change amount from the reference exhaust temperature does not exceed the predetermined value 41 within the certain ignition time from the ignition command outputting time, this is determined as indicating an ignition failure.

Further, as represented by 31*b* and 33*b*, the change amounts of the exhaust temperature in the cases of the cold startup and the hot startup are varied substantially in the same way with the lapse of time when ignition has succeeded. Therefore, the predetermined value 41 of the change amount of the exhaust temperature, which is used as a reference for determining the establishment of ignition, can be set in common with both the cold startup and the hot startup. It is hence possible to eliminate the necessity of setting the predetermined value 41, which is used to determine whether ignition has succeeded or not, for each of the cold startup and the hot startup. According to such a method, whether ignition has established in the combustor or not can be easily determined by using the exhaust temperature sensor. Additionally, when the change amount of the exhaust temperature does not reach the predetermined value 41 and an ignition failure is determined, the flow rate of fuel is reduced to 0 by the fuel flow adjuster 25 shown in FIG. 1.

Another embodiment of the method for determining the establishment of ignition will be described with reference to FIGS. 7 and 8. This embodiment is intended to determine the establishment of ignition by measuring a change rate of the exhaust temperature per unit time after the outputting of the ignition command.

Figure 7:
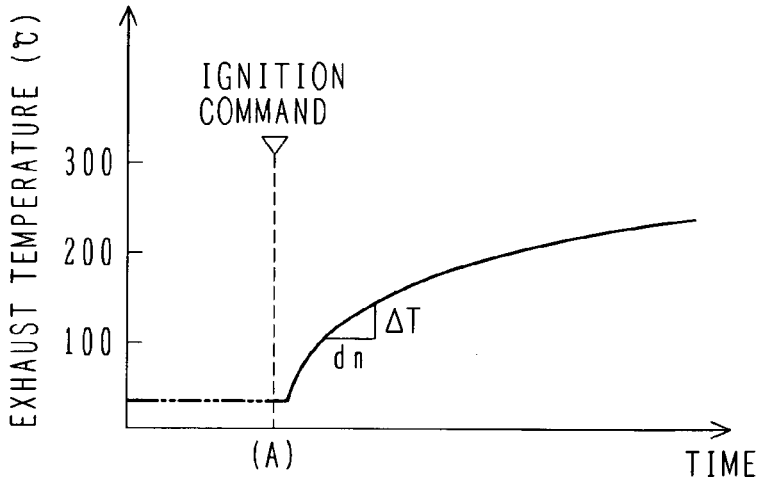
FIG. 7 is a graph for explaining how to calculate a change rate $\Delta T/dt$ of the exhaust temperature per unit time at the time of ignition.
Figure 8:
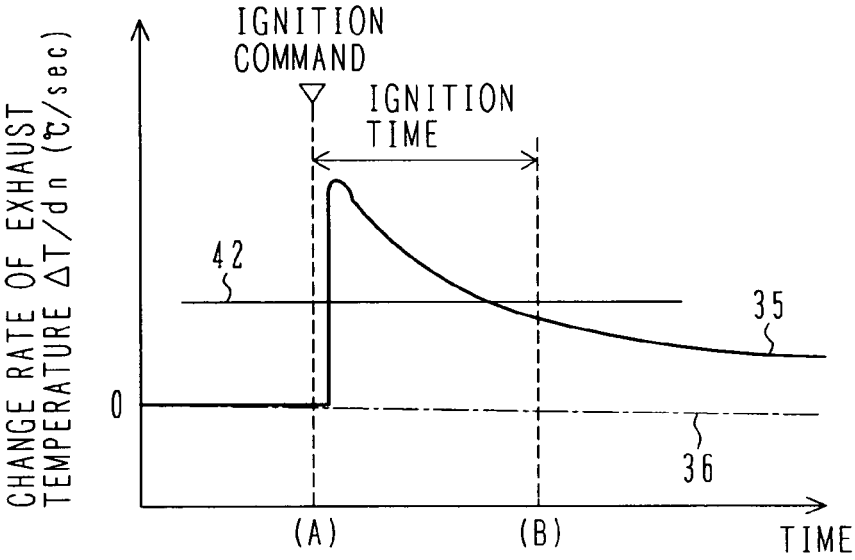
FIG. 8 is a graph showing one example of behavior of the change rate $\Delta T/dt$ of the exhaust temperature per unit time at the time of ignition.

In this embodiment, as shown in FIG. 7, a change rate ΔT/dt of the exhaust temperature per unit time after the outputting of the ignition command is calculated. As shown in FIG. 8, the change rate ΔT/dt of the exhaust temperature per unit time behaves as represented by a solid line 35 when ignition has been established, and behaves as represented by a one-dot chain line 36 when ignition has failed. When ignition has been normally established, the exhaust temperature is abruptly increased for a moment immediately after the outputting of the ignition command and so is the change rate ΔT/dt of the exhaust temperature as represented by the solid line 35. Thereafter, the exhaust temperature rises while the temperature change rate gradually decreases. On the other hand, when ignition has failed, the exhaust temperature does not rise as a matter of course, and the change rate ΔT/dt of the exhaust temperature is not increased as represented by the one-dot chain line 36.

Thus, according to the method for determining the establishment of ignition with this embodiment, the establishment of ignition is determined when the calculated change rate ΔT/dt of the exhaust temperature per unit time exceeds a predetermined value 42 within a predetermined time from the outputting of the ignition command. When the calculated change rate does not reach the predetermined value 42 within the predetermined ignition time, this is determined as indicating an ignition failure and the flow rate of fuel is reduced to 0 by the fuel flow adjuster 25.

Thus, since the change rate ΔT/dt of the exhaust temperature is increased when ignition has succeeded and the change rate ΔT/dt of the exhaust temperature is not increased when ignition has failed, this embodiment can reliably detect the establishment of ignition in the combustor by comparing the change rate with a reference value regardless of the startup conditions of the gas turbine, etc., such as the cold startup or the hot startup.

Still another embodiment of the method for determining the establishment of ignition in the combustor will be described with reference to FIGS. 9 and 10. This embodiment is intended to determine the establishment of ignition by measuring a change rate of the exhaust temperature per unit revolution speed after the outputting of the ignition command.

Figure 9:
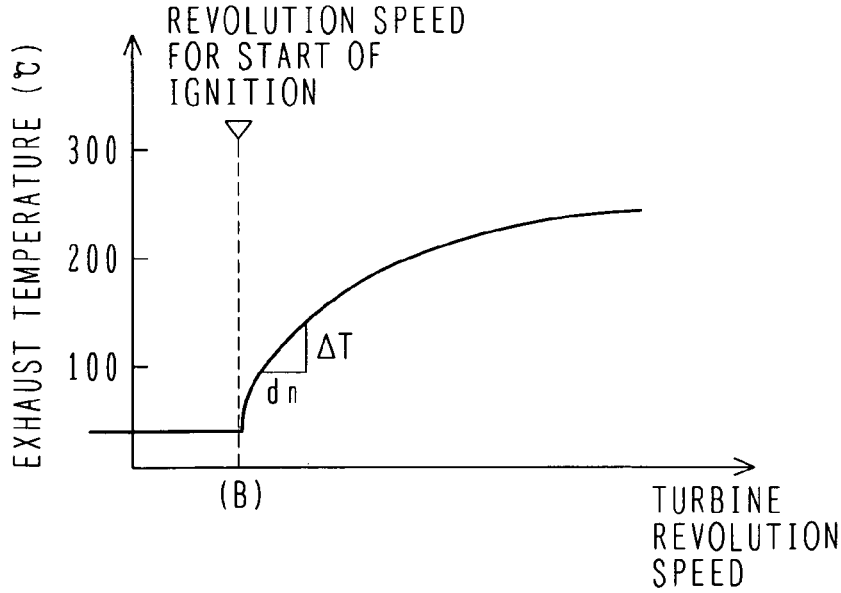
FIG. 9 is a graph for explaining how to calculate a change rate $\Delta T/dn$ of the exhaust temperature per unit revolution speed at the time of ignition.
Figure 10:
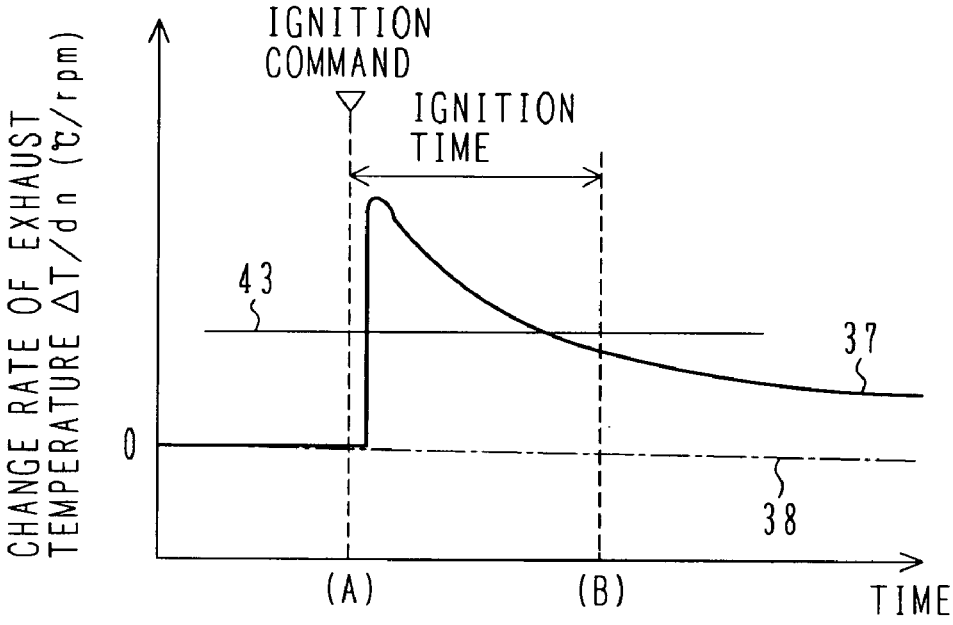
FIG. 10 is a graph showing one example of behavior of the change rate $\Delta T/dn$ of the exhaust temperature per unit revolution speed at the time of ignition.

In this embodiment, as shown in FIG. 9, a change rate ΔT/dn of the exhaust temperature per unit revolution speed of the gas turbine after the outputting of the ignition command is calculated. As shown in FIG. 10, the change rate ΔT/dn of the exhaust temperature per unit revolution speed behaves as represented by a solid line 37 when ignition has been established, and behaves as represented by a one-dot chain line 38 when ignition has failed. Then, according to the method for determining the establishment of ignition with this embodiment, the establishment of ignition is determined when the calculated change rate ΔT/dn of the exhaust temperature per unit revolution speed of the gas turbine exceeds a predetermined value 43 within a predetermined time from the outputting of the ignition command. When the calculated change rate of the exhaust temperature per unit revolution speed does not exceed the predetermined value 43 within a predetermined time from the outputting of the ignition command, this is determined as indicating an ignition failure and the flow rate of fuel is reduced to 0 by the fuel flow adjuster 25.

An ignition failure may also occur when the components of the gas turbine have no abnormality. If the gas turbine is completely stopped upon each ignition failure, it takes a substantial time until the next startup. In this embodiment, therefore, when an ignition failure is determined according to any of the above-described methods for determining the establishment of ignition in the combustor, the ignition command is outputted to the combustor again to repeat the ignition operation. Then, if an ignition failure is determined again with the second ignition operation, this is determined as indicating an abnormality in any component, and the operating mode is shifted the operation for stopping the gas turbine. As a result, reliability in operation of the gas turbine can be improved.

With the embodiments described above, even when no flame sensors are installed, a highly reliable method for detecting a flame at the time of ignition can be provided by using a plurality of exhaust temperature sensors installed on the gas turbine outlet side. Also, a more reliable method for detecting a flame at the time of ignition can be provided by combination with the flame sensors.

What is claimed is:

1. An ignition detecting method for a gas turbine comprising a combustor for burning air and fuel, a turbine driven by combustion gases from said combustor, and an exhaust temperature sensor for detecting an exhaust temperature on the outlet side of said turbine, the method comprising the steps of:

calculating a difference between the exhaust temperature detected at a particular time before outputting of an ignition command for said combustor and the exhaust temperature detected after the outputting of the ignition command; and determining that said combustor is ignited, when the calculated difference is not less than a predetermined value.

2. An ignition detecting method for a gas turbine comprising a combustor for burning air and fuel, a turbine driven by combustion gases from said combustor, and an exhaust temperature sensor for detecting an exhaust temperature on the outlet side of said turbine, the method comprising the steps of:

calculating a change amount of the exhaust temperature detected after outputting of an ignition command for said combustor on the basis of the exhaust temperature detected at a particular time before the ignition command is outputted; and determining that said combustor is ignited, when the calculated change amount exceeds a predetermined value in a predetermined period from the outputting time or the ignition command.

3. An ignition detecting method for a gas turbine comprising a combustor for burning air and fuel, a turbine driven by combustion gases from said combustor, and an exhaust temperature sensor for detecting an exhaust temperature on the outlet side of said turbine, the method being used to detect ignition in said combustor at both of hot startup and cold startup of said gas turbine, the method comprising the steps of:

calculating a difference between the exhaust temperature detected at a particular time before outputting of an ignition command for said combustor and the exhaust temperature detected after the outputting of the ignition command; and determining that said combustor is ignited, when the calculated difference is not less than a predetermined value set in common with the hot startup and the cold startup of said gas turbine.

4. A gas turbine comprising a combustor for burning air and fuel, a turbine driven by combustion gases from said combustor, and an exhaust temperature sensor for detecting an exhaust temperature on the outlet side of said turbine, wherein said gas turbine includes a control unit for calculating a difference between the exhaust temperature detected at a particular time before outputting of an ignition command for said combustor and the exhaust temperature detected after the outputting of the ignition command, and determining that said combustor is ignited, when the calculated difference is not less than a predetermined value.

5. A gas turbine comprising a combustor for burning air and fuel, a turbine driven by combustion gases from said combustor, and an exhaust temperature sensor for detecting an exhaust temperature on the outlet side of said turbine, wherein said gas turbine includes a control unit for calculating a change amount of the exhaust temperature detected after outputting of an ignition command for said combustor on the basis of the exhaust temperature detected at a particular time before the ignition command is outputted, and determining that said combustor is ignited, when the calculated change amount exceeds a predetermined value in a predetermined period from the outputting time of the ignition command.

6. The gas turbine according to claim 4, wherein said control unit controls a flow rate of fuel supplied to said combustor to be zero when said control unit determines that ignition in said combustor has failed.

7. The gas turbine according to claim 4, wherein said control unit outputs the ignition command for said combustor again when said control unit determines that ignition in said combustor has failed, and said control unit stops said gas turbine when said control unit determines at the second time that ignition in said combustor has failed.

8. A control method for a gas turbine comprising a combustor for burning air and fuel, a turbine driven by combustion gases from said combustor, and an exhaust temperature sensor for detecting an exhaust temperature on the outlet side of said turbine, the method comprising the steps of:

calculating a difference between the exhaust temperature detected at a particular time before outputting of an ignition command for said combustor and the exhaust temperature detected after the outputting of the ignition command; and determining that ignition in said combustor has failed, and controlling a flow rate of fuel supplied to said combustor to be zero, when the calculated difference is not more than a predetermined value.

9. A control method for a gas turbine comprising a combustor for burning air and fuel, a turbine driven by combustion gases from said combustor, and an exhaust temperature sensor for detecting an exhaust temperature on the outlet side of said turbine, the method comprising the steps of:

calculating a change amount of the exhaust temperature detected after outputting of an ignition command for said combustor on the basis of the exhaust temperature detected at a particular time before the ignition command is outputted; and determining that ignition in said combustor has failed, and controlling a flow rate of fuel supplied to said combustor to be zero, when the calculated change amount does not exceed a predetermined value in a predetermined period from the outputting time of the ignition command.

* * * * *